US006577056B1

(12) United States Patent
Chang

(10) Patent No.: US 6,577,056 B1
(45) Date of Patent: Jun. 10, 2003

(54) PLASMA DISPLAY APPARATUS

(75) Inventor: Myeong Soo Chang, Yewang (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/537,777

(22) Filed: Mar. 29, 2000

(30) Foreign Application Priority Data

Apr. 1, 1999 (KR) ..... 99-11387

(51) Int. Cl.[7] ..... H01J 17/49
(52) U.S. Cl. ..... 313/493; 313/582; 313/587
(58) Field of Search ..... 313/587, 584, 313/585, 586, 581, 582, 113, 493, 114, 111, 583; 362/255

(56) References Cited

U.S. PATENT DOCUMENTS 4,425,029 A * 1/1984 Funada et al. ..... 350/338
4,803,402 A * 2/1989 Raber et al. ..... 313/509
4,827,186 A * 5/1989 Knauer et al. ..... 313/114
5,276,538 A * 1/1994 Monji et al. ..... 359/40
5,660,461 A * 8/1997 Ignatius et al. ..... 257/668
5,703,437 A * 12/1997 Komaki ..... 313/587
5,813,753 A * 9/1998 Vriens et al. ..... 257/13
5,903,090 A * 5/1999 Haag ..... 313/113
5,946,547 A * 8/1999 Kim et al. ..... 438/30
6,008,580 A * 12/1999 Nakamura et al. ..... 313/568
6,061,111 A * 5/2000 Kataoka et al. ..... 349/113
6,100,633 A * 8/2000 Okumura et al. ..... 313/486
6,140,768 A * 10/2000 Kim ..... 313/584

FOREIGN PATENT DOCUMENTS

JP 3-106654 5/1991
JP 3-246857 11/1991
JP 4-071141 3/1992
JP 9-199041 7/1997

* cited by examiner

*Primary Examiner*—Ashok Patel
(74) *Attorney, Agent, or Firm*—Fleshner & Kim, LLP

(57) ABSTRACT

A plasma display apparatus having a structure capable of improving a light efficiency is disclosed. The reflecting mirror plane or a metal reflecting film is formed on a back surface of a back plate of the plasma display apparatus, so that the back face light is reflected more than 95%, and thus, the light loss due to the back face light can be minimized, so that the light efficiency of the plasma display apparatus can be heightened. Especially, by forming the reflecting film having almost the same diameter as that of the discharge cell and a predetermined curvature at the positions corresponding to the discharge cells on the rear plate of the plasma display apparatus, the light interference between the discharge cells due to the reflected light can be prevented. Also, since the reflecting film serves as a high frequency blocking film, the loss of high frequency of the high frequency plasma display apparatus can be prevented.

25 Claims, 3 Drawing Sheets

PLASMA DISPLAY APPARATUS

BACKGROUND OF THE INVENTION

1. Field of the Invention

The present invention relates to a flat panel display apparatus, and more particularly to a plasma display apparatus having a structure capable of improving a light efficiency.

2. Description of the Background Art

Recently, flat panel display apparatuses such as a liquid crystal display (LCD), a field emission display (FED) and a plasma display panel (PDP) are actively being developed. Especially, the PDP is the most remarkable owing to its advantages in that it is easily produced due to its simple structure, an excellence in the high luminance and a high light-emitting efficiency, a memory function, and a wide view angle more than 160° is obtained, and a large screen more than 40 inches can be implemented.

With reference to FIG. 1, the structure of a surface discharge AC PDP in accordance with a conventional art will now be described.

First, a front plate 10 and a back plate 20 are disposed facing each other spaced apart at a predetermined interval, between which discharge spaces 29 defined by barrier ribs 23 are formed.

A plurality of address electrodes 21 are formed in parallel in one direction on the upper surface of the back plate 20, and the upper surface of the back plate 20 and the upper surface of the address electrodes 21 are covered by a dielectric layer 22.

A plurality of barrier ribs 23 are formed on the upper surface of the dielectric layer 22 between the address electrodes 21. The barrier ribs 23 serve to prevent the discharge spaces 29 prepared between each barrier rib from interfering electrically and optically. Black matrix bands 24 are formed on the upper surface of the barrier ribs 23, to prevent a contrast degradation caused due to reflection of an external light.

A florescent layer 25 is coated on the both wall side of the barrier rib 23 and on the dielectric layer 22 covering the address electrode 21.

On one side of the front plate 10, a sustain/display electrode 11 and a scan electrode 12 are disposed spaced apart at a predetermined interval in the direction perpendicular to the direction of the address electrode 21. As a material of the sustain/display electrode 11 and the scan electrode 12, a translucent material, specifically, an indium tin oxide (ITO), is typically used so that luminescent light can pass through effectively.

Bus electrodes 13 are formed at the end portion of the sustain/display electrodes 11 and the scan electrodes 12, so as to apply a stable driving voltage.

The bus electrode 13 is formed of an Al(aluminum) or Cr/Cu/Cr(chrome/copper/chrome) layer.

A dielectric layer 14 covers the sustain/display electrode 11, the scan electrode 12, the bus electrode 13 and the front plate 10.

An MgO film 15 is coated on the surface of the dielectric layer 14, as a protective film. The MgO protective film protects the PbO dielectric layer from a sputtering of ion. Also, when a low ion energy hits on the surfaced during plasma discharging of the PDP, due to its comparatively high second electronic generation coefficient characteristics, it renders the driving and sustain voltage of the discharge plasma to be lowered down.

The inside of the plasma display panel of FIG. 1, that is, the discharge cells (the discharge spaces 29) surrounded by the barrier ribs are filled with He, Ne or Ar, or their mixed gas and a mixed gas of Xe.

FIG. 2 is a vertical sectional view of the surface discharge AC PDP taken along line of II—II of FIG. 1. The same reference numerals of FIGS. 1 and 2 represent the same elements, and thus, descriptions of FIG. 2 are omitted.

Operational principle of the plasma display panel of the conventional art is as follows.

When a predetermined driving voltage is applied between the sustain/display electrode and the scan electrode, the plasma discharging occurs on the surface of the dielectric layer. Then, the ultraviolet ray generated from the plasma discharging excites the florescent material of a red color, (referred to as 'R', hereinafter), a green color (referred to as 'G', hereinafter) and a blue color (referred to as 'B', hereinafter) so as to be luminescent, and the visible ray of the R, G and B luminescent from the florescent material proceeds to the front plate through the dielectric layer and the display electrode, thereby displaying characters and graphic.

However, as to the plasma display panel of the conventional art has a problem in that the light luminescent from the florescent material is partially leaked through the back plate, degrading the light efficiency.

In an effort to solve the problem, there has been an attempt to heighten the light efficiency in a manner that the a material having a high reflectivity, that is, $TiO_2$, is added in the dielectric layer so that the light luminescent in the discharge cell is directed to the front plate by being reflected on the dielectric layer without being penetrated through the back plate.

However, in spite of applying the method, the luminance of the light leaked through the back plate reaches 20% of the luminance of the light penetrated through the front plate, resulting in that the light efficiency of the plasma display panel is still low.

Light efficiency of the plasma display panel that has been recently developed is quite low, having approximately 1 Im/w, which is the biggest problem in view of commercial use of the plasma display panel. Therefore, the persons in the pertinent art try to find a method for improving light efficiency of the plasma display panel.

SUMMARY OF THE INVENTION

Therefore, an object of the present invention is to provide a plasma display apparatus which is capable of minimizing a loss of a back light through a back plate to thereby improve light efficiency.

To achieve these and other advantages and in accordance with the purposed of the present invention, as embodied and broadly described herein, there is provided a plasma display apparatus of which a back plate has a reflecting film on one side surface thereof.

In order to achieve the object, the reflecting film of the plasma display apparatus is a metal film.

In order to achieve the object, the metal film of the plasma display apparatus is made of one of aluminum, silver copper or chrome.

In order to achieve the object, the reflecting film of the plasma display apparatus is a metal film made by one of sputtering, evaporation, chemical vapor deposition, spin coating or a sol-gel method.

In order to achieve the object, the reflecting film of the plasma display apparatus is a mirror plane.

In order to achieve the object, the mirror plane is formed by using a silver mirror reaction.

In order to achieve the object, one side of a plate of the plasma display panel is flat, and the other side thereof forms a plurality of semicircular curves on which the reflecting film is formed.

In order to achieve the object, a flat plate micro lens is provided on the front surface of the reflecting film so as to condensing incident light.

In order to achieve the object, the plate micro lens is formed only at a portion corresponding to discharge cells between barrier ribs.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

The present invention will now be described with reference to FIGS. 3 through 8.

Figure 1:
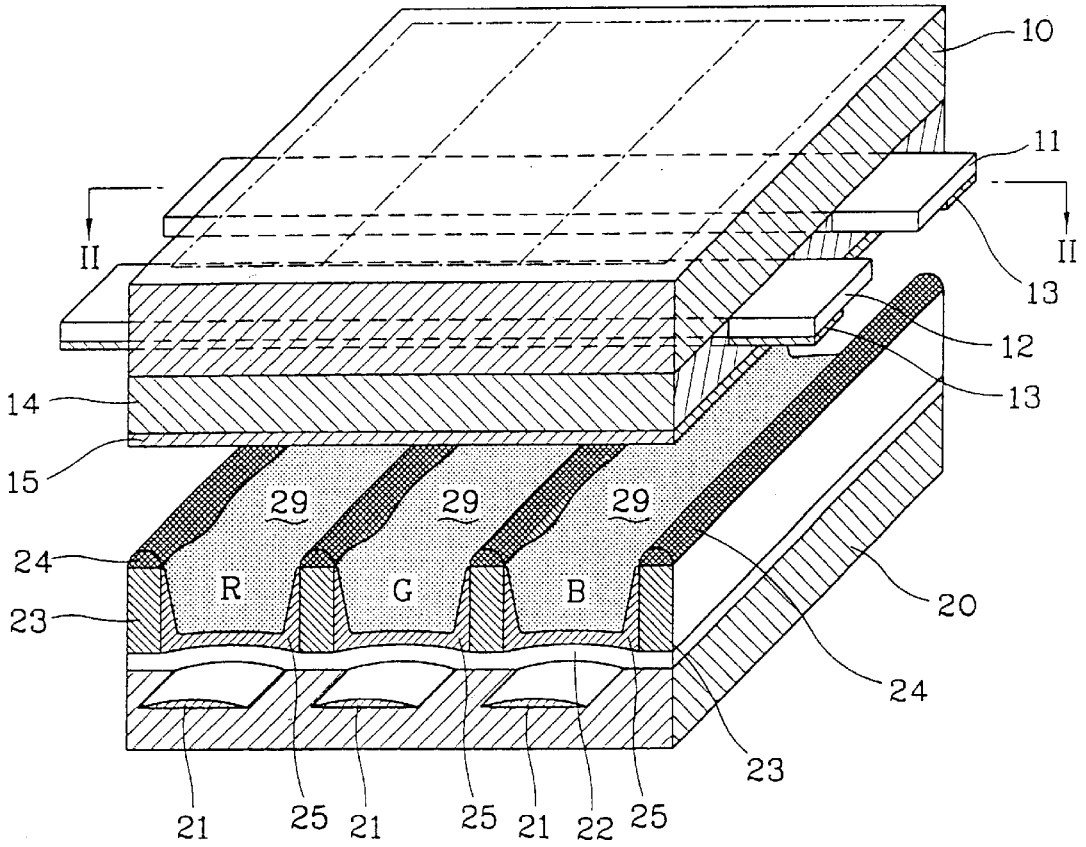
FIG. 1 CONVENTIONAL ART
FIG. 1 is an outer perspective view of a general plasma display apparatus in accordance with a conventional art.
Figure 2:
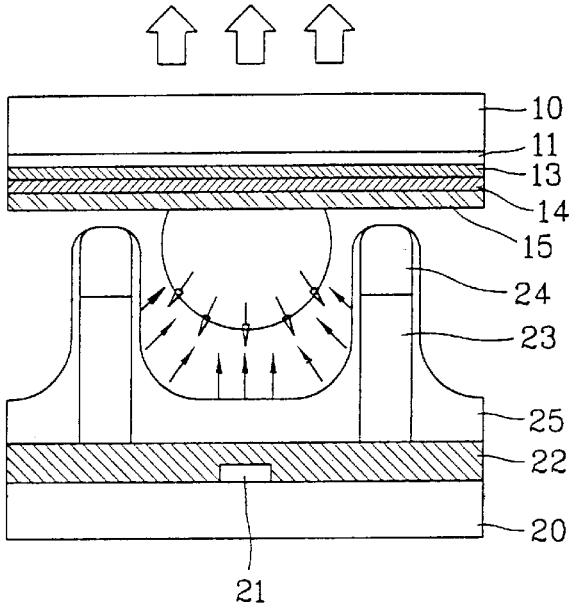
FIG. 2 CONVENTIONAL ART
FIG. 2 is a vertical-sectional view of the plasma display apparatus taken along line II—II of FIG. 1 in accordance with the conventional art.
Figure 3:
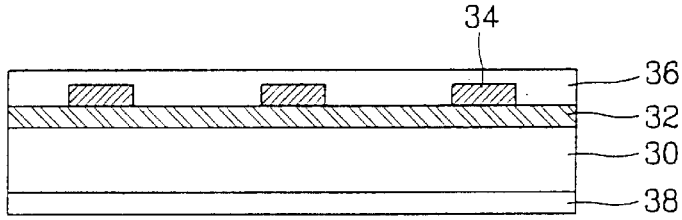
FIG. 3 shows a structure of a back plate of a plasma display apparatus in accordance with a first embodiment of the present invention.

FIG. 3 shows a structure of a back plate of a plasma display apparatus in accordance with a first embodiment of the present invention.

As shown in the drawing, the back plate of the plasma display apparatus. of the first embodiment of the present invention includes a plate 30 made of a glass film; an under layer 32 formed on the plate 30; address electrodes 34 formed on the upper portion of the under layer 32; a dielectric layer 36 formed on the upper surface of the address electrodes 32 and the under layer 32; and a reflecting film 38 formed on the back face of the plate 30. That is, it is constructed in that, by forming the reflecting film 38 on the back face of the plate 30, the back face visible ray generated from a discharge cell and proceeding toward the back plate is reflected on the reflecting film 38 and then again proceeds inwardly of the discharge cell The reflecting film 38 is a mirror plane or a metal film having a high reflectivity.

In case that the reflecting film 38 is a mirror plane, it can be formed by using a silver mirror reaction. The silver mirror reaction is a reaction that a reducing agent such as glucose is added to an alkaline aqueous solution of ammonia of silver acetate to deposit silver on a glass face. By using the silver mirror reaction, silver is deposited on the back face of the glass plate 30, and a copper Cu is coated on the surface of the silver layer so as to protect. the deposited silver layer, thereby forming the reflecting film 38.

Meanwhile, in case that the reflecting film 38 is a metal film, a metal having a high reflectivity, such as aluminum (A1), chrome (Cr), copper (Cu) or silver (Ag), is preferably used as its material, which can be formed by using a generally known method such as sputtering, evaporating, spin-coating, chemical vapor deposition method, sol-gel method. The dielectric layer(36) is usually formed as a reflecting layer. Therefore, the dielectric layer(36) may be excluded in the present invention because of the reflecting film(38).

Figure 4:
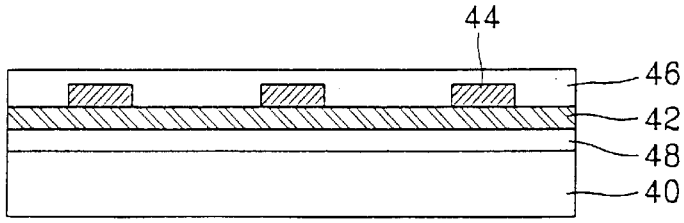
FIG. 4 shows a structure of a back plate of a plasma display apparatus in accordance with a second embodiment of the present invention.

FIG. 4 shows a structure of a back plate of a plasma display panel in accordance with a second embodiment of the present invention.

As shown in the drawing, construction of the back plate of the plasma display panel in accordance with the second embodiment of the present invention is the same as that of the first embodiment, only except that the reflecting film is formed between the lower plate and the under layer, rather than on the back face of the plate as in the first embodiment.

That is, the back plate of the plasma display panel of the second embodiment includes a plate 40, a reflecting film 48 formed on the front face of the plate 40, an under layer 42 formed on the upper surface of the reflecting film 48, a plurality of address electrodes 44 formed on the upper surface of the under layer 42, and a dielectric layer 46 formed on the upper surface of the address electrodes 44 and the under layer 42.

A material and a method for forming the reflecting film 48 are the same as in the first embodiment as described above. The under layer 42 serves as an insulation film for preventing a short between the address electrode 44 and the is metal, that is, the material for the reflecting film 48.

Figure 5:
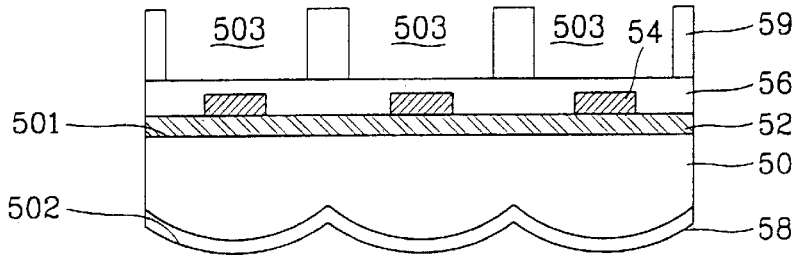
FIG. 5 shows a structure of a back plate of a plasma display apparatus in accordance with a third embodiment of the present invention.

FIG. 5 shows a structure of a back plate of a plasma display panel in accordance with a third embodiment of the present invention.

The elements constructing a back plate of the plasma display panel in accordance with the third embodiment of the present invention are the same as those of the first embodiment, except that its structure (form) of the plate.

That is, the back plate of the plasma display panel of the third embodiment includes a glass plate 50 of which one side 501 is even while the other side 502 is uneven, an under layer 52 formed on the front side of the plate 50, that is, on the upper surface of the even side 501, address electrodes 54 formed on the upper surface of the under layer 52, and a dielectric layer 56 formed on the upper surface of the address electrode 54 and of the under layer 52.

Barrier ribs 59 are formed on the upper surface of the dielectric layer 56. A reflecting film 58 is formed on the back face of the plate 50, that is, on the upper surface of the uneven side 502, having a uniform thickness.

The back face of the plate 50 has a form that the portions corresponding to the barrier ribs 59 are concave while the portions corresponding to discharge cell 503, that is, between the barrier ribs are concave in a semicircular form, of which the concave portions and the concave portions are regularly formed. In other words, semicircular convex portions are regularly formed on the back face of the plate 50, having almost the same diameter as the discharge cell.

Accordingly, the reflecting film 58 formed on the back face of the plate 50 has a diameter as long as the discharge cell and a constant curvature. Thus, when a visible ray generated in an arbitrary discharge cell is reflected into the discharge cell by the reflecting film 58, since the reflected light is reflected into the same discharge cell, light interference due to the reflected light between the discharge cells can be prevented.

In other words, as shown in FIG. 3, in case where the reflecting film 38 is formed in parallel to the plate 30, since there exists a gap as thick as the formation of the plate 30, the electrode 34 and the dielectric layer 36 between the lower portion of the barrier rib and the reflecting film 38, a visible ray generated from an arbitrary discharge cell is irregularly reflected on the reflecting film 38 to penetrate into the adjacent discharge cell, possibly causing a light interference phenomenon.

However, as shown in FIG. 5, the reflecting film 58 is formed to have the semicircular curved face, so that the reflected light is reflected on the curved face of the reflecting film 58, directing into the discharge cell, thereby preventing a light intererference of the adjacent discharge cell due to the reflected light.

A material and a method for forming the reflecting film 58 of the third embodiment are the same as those in the description of the first embodiment.

Figure 6:
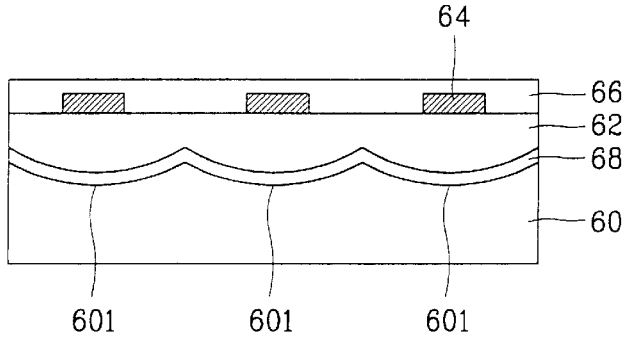
FIG. 6 shows a structure of a back plate of a plasma display apparatus in accordance with a fourth embodiment of the present invention.

FIG. 6 shows a structure of a back plate of a plasma display panel in accordance with a fourth embodiment of the present invention.

As shown in the drawing, the back plate of the plasma display panel of the fourth embodiment includes a plate 60 of which a back face is even and a front face has a plurality of grooves 601, a reflecting film 68 formed on the front face of the plate 60 with a constant thickness, an under layer 62 formed on the upper surface of the reflecting film 68, filling each groove 601 and having an even upper surface, address electrodes 64 formed at central portions of the grooves 601 on the upper surface of the address electrodes 64 and of the under layer 62. The under layer 62 is made of an insulation layer to prevent the reflecting film 68 and the address electrode 64 from electrically conducting.

A material and a method forming the reflecting film 68 of the fourth embodiment are the same as those in the first embodiment as described above.

Figure 7:
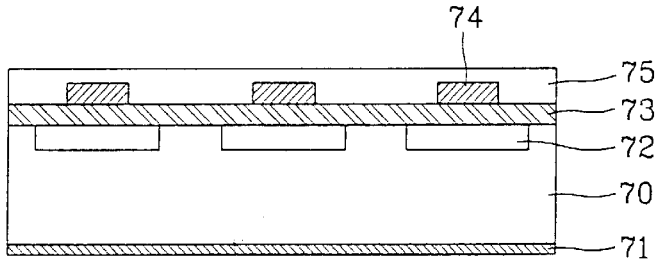
FIG. 7 shows a structure of a back plate of a plasma display apparatus in accordance with a fifth embodiment of the present invention.

FIG. 7 shows a structure of a back plate of a plasma display panel in accordance with a fifth embodiment of the present invention.

As shown in the drawing, the back plate of the plasma display panel of the fifth embodiment of the present invention includes a reflecting film 71 formed on the back surface of a plate 70, a gradient index (GRIN) lens 72 formed on the front surface of the plate 70, and an under layer 73 is formed on the upper surface of the GRIN lens 72 and the plate 70, a plurality of address electrodes 74 formed on the upper surface of the under layer 73, and a dielectric layer 75 formed on the upper surface of the address electrodes and of the under layer 73.

The GRIN lens 72, having the same size as the discharge cell (not shown), formed only on the portions corresponding to the discharge cells.

The GRIN lens of the fifth embodiment refers to a distribution refractive index lens. The distribution refractive index lens includes an array lens such as a SELFOC and a flat plate type lens.

The present invention employs the flat plate micro lens. The distribution refractive index flat plate micro lens can be made in two-dimensional matrix forms by selectively performing an ion exchange on the flat surface of the lower plate 70 by using a mask.

The back plate of the plasma display panel of the fifth embodiment of the present invention is featured in that the GRIN lens 72 is formed on the front surface of the back plate 70.

Figure 8:
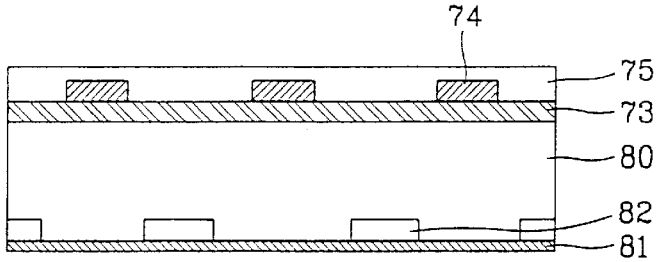
FIG. 8 shows a structure of a back plate of a plasma display apparatus in accordance with a sixth embodiment of the present invention.

However, as shown in FIG. 8 which shows a back plate of a plasma display panel of a sixth embodiment of the present invention, a GRIN lens 82 may be also formed on the back surface of the plate 80, that is, between the back plate 80 and a reflecting film 81.

The sixth embodiment of the present invention of FIG. 8 has the same elements as those of the fifth embodiment of FIG. 7, except the reference numerals 80, 81.

As in the fifth and sixth embodiments, by forming the GRIN lenses 72 and 82 over the reflecting films 71 and 81, the reflected light reflected on the reflecting film and made incident on the GRIN lenses 72 and 82 is condensed and proceeds toward the discharge cells. Therefore, the light interference phenomenon between adjacent discharge cells due to the reflected light can be prevented.

Also, in case that the plasma display panel according to the first embodiment to the sixth embodiment of the present invention to a high frequency plasma display panel, the reflecting film, that is, the metal material of the mirror plane can block the high frequency, so that loss of the high frequency can be by passing through the lower plate.

As so far described, according to the plasma display panel of the present invention, the reflecting mirror plane or a metal reflecting film is formed on the lower plate, so that the back face light is reflected more than 95%, and thus, the light loss due to the back face light can be minimized, so that the light efficiency of the plasma display panel can be heightened.

Especially, by forming the reflecting film having almost the same diameter as that of the discharge cell and a predetermined curvature at the positions corresponding to the discharge cells on the lower plate of the plasma display panel, the light interference between the discharge cells due to the reflected light can be prevented.

Also, since the reflecting film serves as a high frequency blocking film, the loss of high frequency of the high frequency plasma display panel can be prevented.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalence of such meets and bounds are therefore intended to be embraced by the appended claims.

What is claimed is:

1. A plasma display apparatus including a back plate having a first and second surface, wherein on the first surface a dielectric layer and an electrode are formed, wherein a reflecting film is formed on the second surface of the plate, and wherein semicircular curve forms are formed on the second surface of the back plate on which the reflecting film is formed.

2. The plasma display apparatus according to claim 1, wherein the reflecting film is a metal film.

3. The plasma display apparatus according to claim 2, wherein the metal film is made of at least one of aluminum, silver, copper or chrome.

4. The plasma display apparatus according to claim 1, wherein the reflecting film is made by one of sputtering, evaporation, chemical vapor deposition, spin coating or a sol-gel method.

5. The plasma display apparatus according to claim 1, wherein the reflecting film is a mirror.

6. The plasma display apparatus according to claim 1, wherein the reflecting film is formed by using a silver mirror reaction.

7. The plasma display apparatus according to claim 1, wherein the plasma display apparatus comprises a plurality of discharge cells, wherein the semicircular curve forms on the second surface of the back plate comprises a series of arcs concave toward the dielectric layer, and wherein each arc corresponds to one of the plurality of discharge cells in the plasma display apparatus.

8. A plasma display apparatus including a back plate having a first and second surface, wherein on the first surface a dielectric layer and an electrode are formed, wherein a reflecting film is formed on the first surface of the plate, and wherein semicircular curve forms are formed on the first surface of the back plate.

9. The plasma display apparatus according to claim 8, wherein the plasma display apparatus comprises a plurality of discharge cells, wherein the semicircular curve forms on the first surface of the back plate comprises a series of arcs concave toward the dielectric layer, and wherein each arc corresponds to one of the plurality of discharge cells in the plasma display apparatus.

10. A plasma display apparatus including a back plate having a first and second surface, wherein on the first surface a dielectric layer and an electrode are formed, wherein a reflecting film is formed on the second surface of the plate, and wherein a lens is further formed on the first surface of the back plate.

11. The plasma display apparatus according to claim 10, wherein the lens is a flat plate micro lens.

12. A plasma display apparatus including a back plate having a first and second surface, wherein on the first surface a dielectric layer and an electrode are formed, wherein a reflecting film is formed on the second surface of the plate, and wherein a lens is formed on the second surface of the back plate, between the back plate and the reflecting film to be corresponded to each discharge cell.

13. The plasma display apparatus according to claim 12, wherein the lens is a flat plate micro lens.

14. A plasma display apparatus, comprising:

a back plate having a first surface and a second surface, wherein the first surface has a dielectric layer and an electrode formed thereon;

a plurality of discharge cells formed above the first surface of the back plate;

a reflecting layer formed on the first surface of the back plate; and wherein the first surface of the back plate has semicircular portions formed thereon, whereby the reflecting layer, the dielectric layer and the electrode are located between the plurality of discharge cells and the semicircular portions.

15. The plasma display apparatus according to claim 14, wherein a plurality of lens elements, each lens element corresponding to each discharge cell, are formed between the back plate and the reflecting layer.

16. The plasma display apparatus according to claim 14, wherein a plurality of lenses are formed on the second surface of the back plate, wherein each lens is located opposite one of the plurality of discharge cells.

17. A plasma display apparatus, comprising:

a back plate having a first surface and second surface, wherein the first surface has a dielectric layer and an electrode formed thereon;

a reflecting layer formed on the second surface of the back plate; and a plurality of discharge cells formed above the first surface of the back plate, wherein the second surface of the back plate has semicircular portions formed thereon and the reflecting layer covers the semicircular portions.

18. The plasma display apparatus according to claim 17, wherein a plurality of lens elements, each lens element corresponding to each discharge cell, are formed between the back plate and the reflecting layer.

19. The plasma display apparatus according to claim 17, wherein a plurality of lenses are formed on the second surface of the back plate, wherein each lens is located opposite one of the plurality of discharge cells.

20. A plasma display device, comprising:

a front substrate;

a rear substrate having a first surface and second surface, the first surface facing the front substrate;

a light emitting means operatively located between the front and rear substrates, and emitting light therefrom; and a reflective layer formed in contact with the first or second surface of the rear substrate to reflect any light reaching the rear substrate back towards the front substrate, wherein the first surface of the rear substrate has irregularities formed integrally thereon, and wherein the reflective layer is formed in contact with the irregularities.

21. The device of claim 20, wherein the irregularities form a plurality of concave portions on the first surface of the rear substrate, the concave portions reflecting any light traveling to the rear substrate back towards the front substrate.

22. A plasma display device, comprising:

a front substrate;

a tear substrate having a first surface and second surface, the first surface facing the front substrate;

a light emitting means operatively located between the front and rear substrates, and emitting light therefrom; and a reflective layer formed in contact with the first or second surface of the rear substrate to reflect any light reaching the rear substrate back towards the front substrate, wherein the second surface of the rear substrate has irregularities formed integrally thereon, and wherein the reflective layer is formed in contact with the irregularities.

23. The device of claim wherein the irregularities form a plurality of convex portions on the second surface of the rear substrate, the convex portions reflecting any light traveling through the first surface of the rear substrate back towards the front substrate.

24. A plasma display device, comprising:

a front substrate;

a rear substrate having a first surface and second surface, the first surface facing the front substrate;

a light emitting means operatively located between the front and rear substrates, and emitting light therefrom; and a reflective layer formed in contact with the first or second surface of the rear substrate to reflect any light reaching the rear substrate back towards the front substrate, and further comprising a plurality of lens elements formed in the rear substrate and flush with the first surface of the rear substrate.

25. A plasma display device, comprising:

a front substrate;

a rear substrate having a first surface and second surface, the first surface facing the front substrate;

a light emitting means operatively located between the front and rear substrates, and emitting light therefrom; and a reflective layer formed in contact with the first or second surface of the rear substrate to reflect any light reaching the rear substrate back towards the front substrate, and further comprising a plurality of lens elements formed in the rear substrate and flush with the second surface of the rear substrate.

* * * * *